US008151904B2

(12) United States Patent
Krueger et al.

(10) Patent No.: US 8,151,904 B2
(45) Date of Patent: Apr. 10, 2012

(54) METHOD FOR IMPROVED WELL CONTROL WITH A DOWNHOLE DEVICE

(75) Inventors: Sven Krueger, Winsen (DE); Jens Uwe Bruns, Burgdorf (DE)

(73) Assignee: Baker Hughes Incorporated, Houston, TX (US)

( * ) Notice: Subject to any disclaimer, the term of this patent is extended or adjusted under 35 U.S.C. 154(b) by 156 days.

(21) Appl. No.: 11/770,097

(22) Filed: Jun. 28, 2007

(65) Prior Publication Data

US 2008/0029306 A1 Feb. 7, 2008

Related U.S. Application Data

(60) Provisional application No. 60/818,071, filed on Jun. 30, 2006.

(51) Int. Cl.

| | |
|---|---|
| ***E21B 7/00*** | (2006.01) |
| ***E21B 44/00*** | (2006.01) |
| ***E21B 47/00*** | (2012.01) |
| ***E21B 21/08*** | (2006.01) |

(52) U.S. Cl. ..... 175/57; 175/25; 175/40; 175/48

(58) Field of Classification Search ..... 175/25, 175/48, 40, 57

See application file for complete search history.

(56) References Cited

U.S. PATENT DOCUMENTS

| | | | | |
|---|---|---|---|---|
| 3,322,215 | A | | 5/1967 | Warrington |
| 3,427,651 | A | | 2/1969 | Bielstein et al. |
| 3,503,445 | A | | 3/1970 | Cochrum et al. |
| 3,529,665 | A | | 9/1970 | Malone et al. |
| 3,908,769 | A | * | 9/1975 | Schuyf et al. ..... 175/48 |
| 4,076,083 | A | | 2/1978 | Sizer |
| 4,367,794 | A | | 1/1983 | Bednar et al. |
| 4,473,122 | A | | 9/1984 | Tamplen |
| 4,588,035 | A | * | 5/1986 | Van Gils et al. ..... 175/48 |
| 4,771,408 | A | | 9/1988 | Kotlyar |
| 5,303,582 | A | | 4/1994 | Miska |
| 5,404,953 | A | | 4/1995 | Sangesland |
| 5,803,186 | A | | 9/1998 | Berger et al. |
| 2005/0098349 | A1 | * | 5/2005 | Krueger et al. ..... 175/25 |

* cited by examiner

*Primary Examiner* — Jennifer H Gay

(74) *Attorney, Agent, or Firm* — Mossman, Kumar & Tyler, PC

(57) ABSTRACT

A drilling system includes a downhole well control device that can be used to control out-of-norm wellbore conditions. The downhole well control device can control one or more selected fluid parameters. The well control device in cooperation or independent of surface devices exerts control over one or more drilling or formation parameters to manage an out-of-norm wellbore condition. An exemplary well control device hydraulically isolates one or more sections of a wellbore by selectively blocking fluid flow in a pipe bore and an annulus. The control device also selectively flows fluid from the pipe bore to the annulus. A communication device provides on-way or bidirectional signal and/or data transfer between the controller(s), surface personnel and the well control device. Exemplary application of the well control device include controlling a well kick, controlling drilling fluid being lost to the formation and controlling a simultaneous kick and loss.

22 Claims, 8 Drawing Sheets

METHOD FOR IMPROVED WELL CONTROL WITH A DOWNHOLE DEVICE

CROSS-REFERENCE TO RELATED APPLICATIONS

This application takes priority from U.S. Provisional Patent Application Ser. No. 60/818,071, filed Jun. 30, 2006.

BACKGROUND OF THE INVENTION

1. Field of the Invention

The present invention relates to systems and methods for well control during oilfield operations in situations such as kicks of formation fluids, mud losses and underground blowouts.

2. Description of the Related Art

During construction or servicing of a hydrocarbon producing well, an operator can encounter a number of undesirable conditions that can pose a hazard to equipment and personnel. One undesirable condition is a "kick." During drilling, a high pressure formation fluid can invade the well bore and displace drilling fluid from the well. The resulting pressure "kick" can lead to a well blow-out at the surface. Conventionally, during drilling, the mud weight of a drilling fluid circulated in the well is selected to provide a hydrostatic pressure that minimizes the risk and impact of a "kick." Additionally, drilling rigs use surface blowout preventers to protect against the uncontrolled flow of fluids from a well. When activated, blowout prevention systems "shut-in" a well at the surface to seal off and to thereby exert control over the kick. A typical blowout preventer system or "stack" usually includes a number of individual blowout preventers, each being designed to seal the well bore and withstand pressure from the wellbore. Another undesirable condition is a loss of drilling fluid into a formation. That is, in some instances, the drilling fluid pumped into the wellbore is at a pressure that causes some or all of the drilling fluid to penetrate into the formation rather than flow back up to the surface. A loss is usually treated by circulating a lost circulation material (LCM) into the wellbore. The LCM usually includes particles that plug and seal the fractured or weak formation. Yet another undesirable condition is an underground blowout, which is generally understood as an undesirable subsurface cross flow between two reservoirs intersected by a wellbore. Such a cross flow can be caused when a drilling crew activates a surface blowout preventer to suppress and control a kick. The shut-in well can cause an annulus pressure increase that fractures one or more zones in an open hole region. Drilling fluid is then lost to this fractured zone. This condition can be require a combination of measures, including the use of LCM and well shut-in, to control.

The present invention provides systems and devices adapted to enhance control over the above-described undesirable conditions as well as other out-of-norm conditions.

SUMMARY OF THE INVENTION

In aspects, the present invention provides a drilling system that includes a downhole well control device that can be used to control one or more out-of-norm conditions that can occur when drilling or servicing a well; e.g., a kick, an underground blowout or a fluid loss into a formation. By out-of-norm condition, it is meant any condition that could pose a hazard to personnel, the environment, or equipment. Out-of-norm conditions also include conditions that could interrupt work activities or damage the well. The downhole well control device can control fluid pressure, the rate of flow, the direction of flow and/or the conduits or paths in which one or more fluids flow. The fluids controlled can be engineered fluids such as a drilling fluid, cement, and fluids containing LCM as well as formation fluids such as gas, oil and water. The well control device in cooperation or independent of the surface blow-out preventer and other surface equipment exerts control over one or more drilling or formation parameters to manage an out-of-norm wellbore condition.

In some embodiments, the well control device is configured to hydraulically isolate one or more sections of a wellbore. An exemplary well control device includes a pipe bore flow control device to selectively block fluid flow in a pipe bore, an annulus flow control device that selectively blocks fluid flow in a well annulus, and a bypass flow control device that selectively flows fluid from the pipe bore to the annulus. Depending on the settings of each of these flow devices, e.g., open, closed, or throttled, an out-of-norm condition associated with one or more of these isolated wellbore section can be treated independently, sequentially or concurrently. In embodiments, a surface controller and/or a downhole controller controls the well control device. A communication device provides one-way or bidirectional signal and/or data transfer between the controller(s), surface personnel and the well control device. In one arrangement, the surface controller transmits a downlink encoded with instructions for operating the well control device. The surface controller can also receive uplinks from the downhole controller that are encoded with data relating to sensor measurements, e.g., measured pressure, the operating status of the downhole well control device, or other such data. The downhole controller can be programmed to automatically control the well control device without downlink instructions and/or send uplink signals prior to activating or de-activating the well control device. Suitable communication devices can utilize flow variations, pressure pulses, EM signals, acoustic signals, signals conducted via metal or optical wires, and/or controlled manipulation of a work string. In one embodiment, the bypass valve may be used to generate pressure pulses and/or flow variations to transmit data to the surface.

One exemplary application of a well control device is to control a well kick. Upon detection of a kick, the well control device closes the pipe bore, seals off the annulus, and opens the bypass valve. Next, based on available information, e.g., surface/downhole measured pressure, a "kill" mud weight is determined and pumped into the wellbore. The open bypass valve allows circulation of the kill mud above the well control device to circulate out formation fluids that were not shut-in below the well control device. After the annulus above well control device is filled with the kill mud, the well control device is de-activated to provide normal flow through the pipe bore and annulus.

Another exemplary application of a well control device is to control drilling fluid being lost to the formation due to weak formations. After a loss is detected, the well control device is activated to stop flow in the annulus and pipe bore and the bypass valve is opened. If mud is lost above the well control device, lost circulation material (LCM) is circulated using the open bypass valve. After losses are cured, the well control device is de-activated. If mud is lost below the well control device, the entire annulus above the well control device is maintained full of mud to prevent a kick in the open hole section above the well control device and below a casing shoe. Next, cuttings are circulated out of the wellbore above the well control device and LCM is added to the mud being pumped down. At this point, there are at least three options for pumping LCM into the loss zone below the well control device. One option is to close the bypass valve, open the pipe valve and force LCM into the loss zone until losses are stopped. Thereafter, the well control device is deactivated. A variation to this option is to use cement instead of LCM, which may require pulling the drill bit off bottom. A second option is to keep the bypass valve open and use a non-return valve to prevent flow from the annulus into the pipe bore through the bypass valve. Next, LCM is circulated until full returns are seen at surface, which indicates that losses have stopped. Thereafter, the well control device is de-activated. A third option is to keep the bypass valve open without using a non-return valve. The bypass valve, however, uses a restricted flow to prevent flow from the annulus into the pipe bore. The well control device is de-activated after losses have stopped.

Yet another exemplary application of a well control device is to control a simultaneous kick and loss, i.e., an underground blowout. After detection of an underground blowout, the well control device is activated in a manner previously described. Losses above the well control device are treated by circulating LCM until losses have stopped. After losses are stopped, kill mud, with or without LCM, is circulated above the well control device. Thereafter, the previously described steps for controlling a kick are initiated. For losses below the well control device and the kick above the well control device, a standard kill procedure utilizing surface equipment is applied to kill the kick after refilling the annulus with mud. In a variant, the kill procedure may be preceded by a preparation for cementing the loss zone. After the well is killed above the well control device, two options are available. One option is to add LCM to the kill mud, de-activate the well control device, and start circulation. Another option is to first pump LCM into the formation and start circulation only after losses have stopped.

In another aspect, embodiments of the present invention can utilize downhole pressure measurements to determine parameters such as wellbore pressure. For example, conventionally, after a surface shut-in, the stand pipe pressure is measured to determine wellbore pressure. Embodiments of the present invention can, after activation of the well control device, measure the pressure of the fluid in the annulus or the pipe bore below the well control device to determine wellbore pressure. This pressure measurement can be uplinked to the surface for use in calculating an appropriate kill mud weight or for some other purpose.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
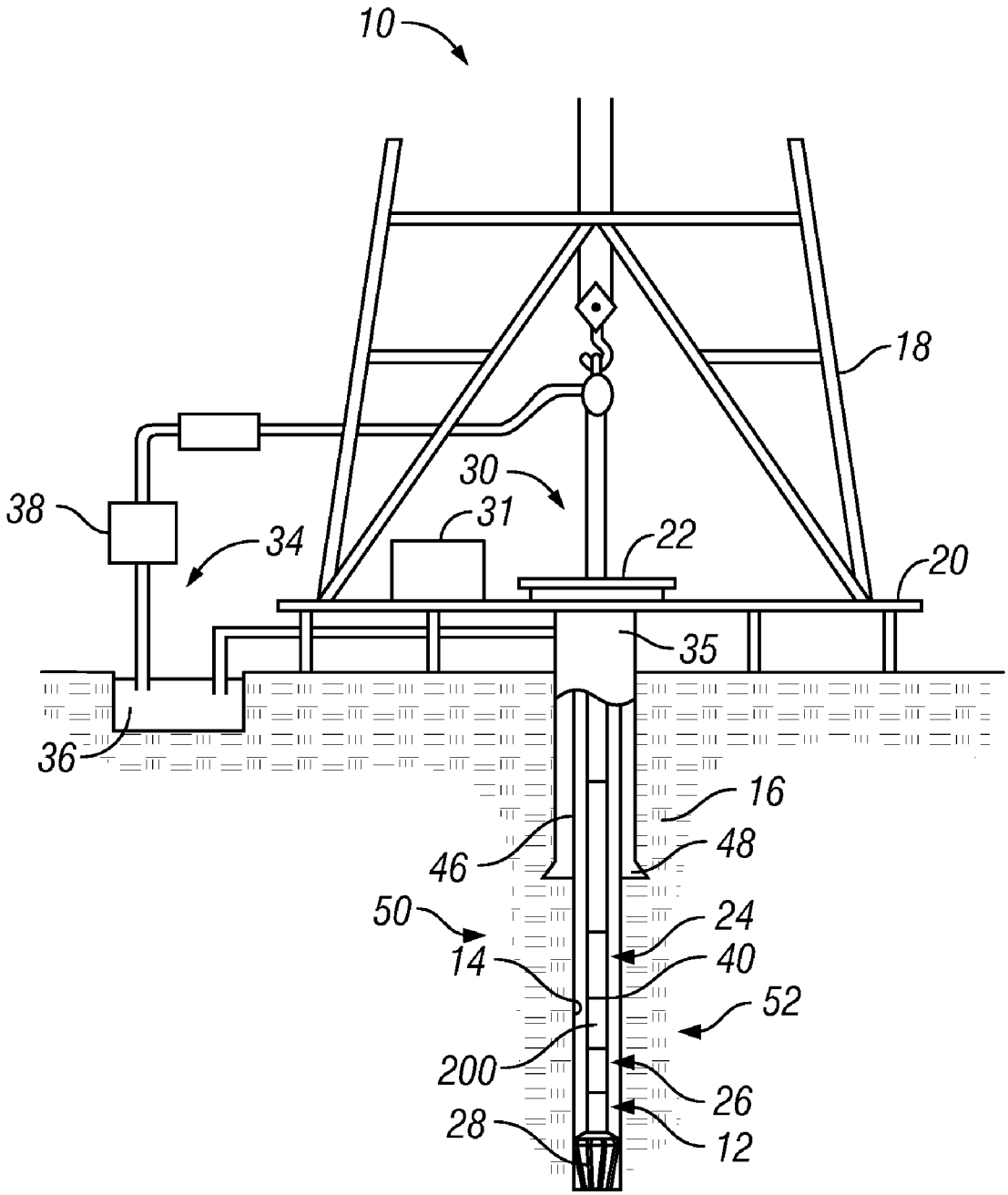
FIG. 1 schematically illustrates a well construction system utilizing a downhole well control device made in accordance with the present invention.

The present invention relates to devices and methods for control of fluid flow in a wellbore. The fluid may be a liquid, a gas, a slurry or mixtures of same. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1 there is shown a schematic diagram of a well construction system 10 having one or more well tools 12 shown conveyed in a borehole 14 formed in a formation 16. The system 10 can be configured for performing one or more operations related to the construction, logging, completion or work-over of a hydrocarbon producing well. In particular, FIG. 1 shows a schematic elevation view of one embodiment of a wellbore drilling system 10 for drilling a wellbore 14 using conventional drilling fluid circulation. The drilling system 10 is a rig for land wells but can be a drilling platform, which may be a drill ship or another suitable surface workstation such as a floating platform or a semi-submersible for offshore wells. For offshore operations, additional known equipment such as a riser and subsea wellhead will typically be used. The system 10 includes a conventional derrick 18 erected on a floor 20. A string 24, such as a tool string, work string, or drill string, extends downward from the surface into the borehole 14. The string 24 can be formed partially or fully of drill pipe, metal or composite coiled tubing, liner, casing or other known members. Additionally, the tubing string 24 can include data and power transmission carriers such fluid conduits, fiber optics, and metal conductors. The string 24 and well tool 12 can include any type of equipment including a steerable drilling assembly, a drilling motor, measurement-while-drilling assemblies, formation evaluation tools, drill collars or drill pipe. For simplicity, a bottomhole drilling assembly (BHA) 26 is showing having a drill bit 28 and attached to the end of the drill string 24. The bit can be rotated by a surface rotary drive or a motor using pressurized fluid (e.g., mud motor) or an electrically driven motor. To drill the wellbore 14, the BHA 26 is conveyed to the wellhead equipment 30 and then inserted into the wellbore 14 using a suitable system. Additionally a surface controller 31 can be connected to system 10 to provide automated or semi-automated control over the system 10. The controller 31 can also be operatively coupled to a suitable communication device (not shown) that provides communication with downhole equipment. In one embodiment, the suitable communication device is configured to transmit downlinks encoded with instructions for operation of the well control device 200. In other embodiments, the suitable communication device is also configured to receive uplinks encoded with data relating to sensor measurements or the operating status of the well control device 200.

To drill the wellbore 14, well control equipment 30 (also referred to as the wellhead equipment) is placed above the wellbore 14. The wellhead equipment 30 includes a surface blow-out-preventer (BOP) stack 22 and a lubricator (not shown) with its associated flow control. Additionally a surface choke 35 in communication with a wellbore annulus 40 can control the flow of fluid out of the wellbore 14 to provide a back pressure as needed to control the well.

During drilling, a drilling fluid from a surface mud system 34 is pumped under pressure down the drill string 24. The mud system 34 includes a mud pit 36 and one or more pumps 38. The drill bit 28 disintegrates the formation (rock) into cuttings. The drilling fluid leaving the drill bit travels uphole through an annulus 40 between the drill string 24 and the wellbore wall, carrying the entrained drill cuttings. The return fluid discharges into a separator (not shown) that separates the cuttings and other solids from the return fluid and discharges the clean fluid back into the mud pit 36.

Once the well 14 has been drilled to a certain depth, casing 46 with a casing shoe 48 at the bottom is installed. The drilling is then continued to drill the well to a desired depth that will include one or more production sections, such as section 50. The section below the casing shoe 48 may not be cased until it is desired to complete the well, which leaves the bottom section of the well as an open hole, as shown by numeral 52.

In one embodiment, the drilling system 10 includes a well control device 200 that controls the rate of flow, the direction of flow and/or the conduits or paths in which one or more fluids flow. As will be seen, the well control device 200 in cooperation or independent of the surface blow-out preventer stack 22 and other surface equipment can exert control over one or more parameters relating to wellbore fluids or the formation in order to manage an out-of-norm wellbore condition such as a kick or a fluid loss into a formation. By out-of-norm condition, it is meant any condition that could pose a hazard to personnel, the environment, or equipment. Out-of-norm conditions also include conditions that could interrupt work activities or damage the well.

Figure 2:
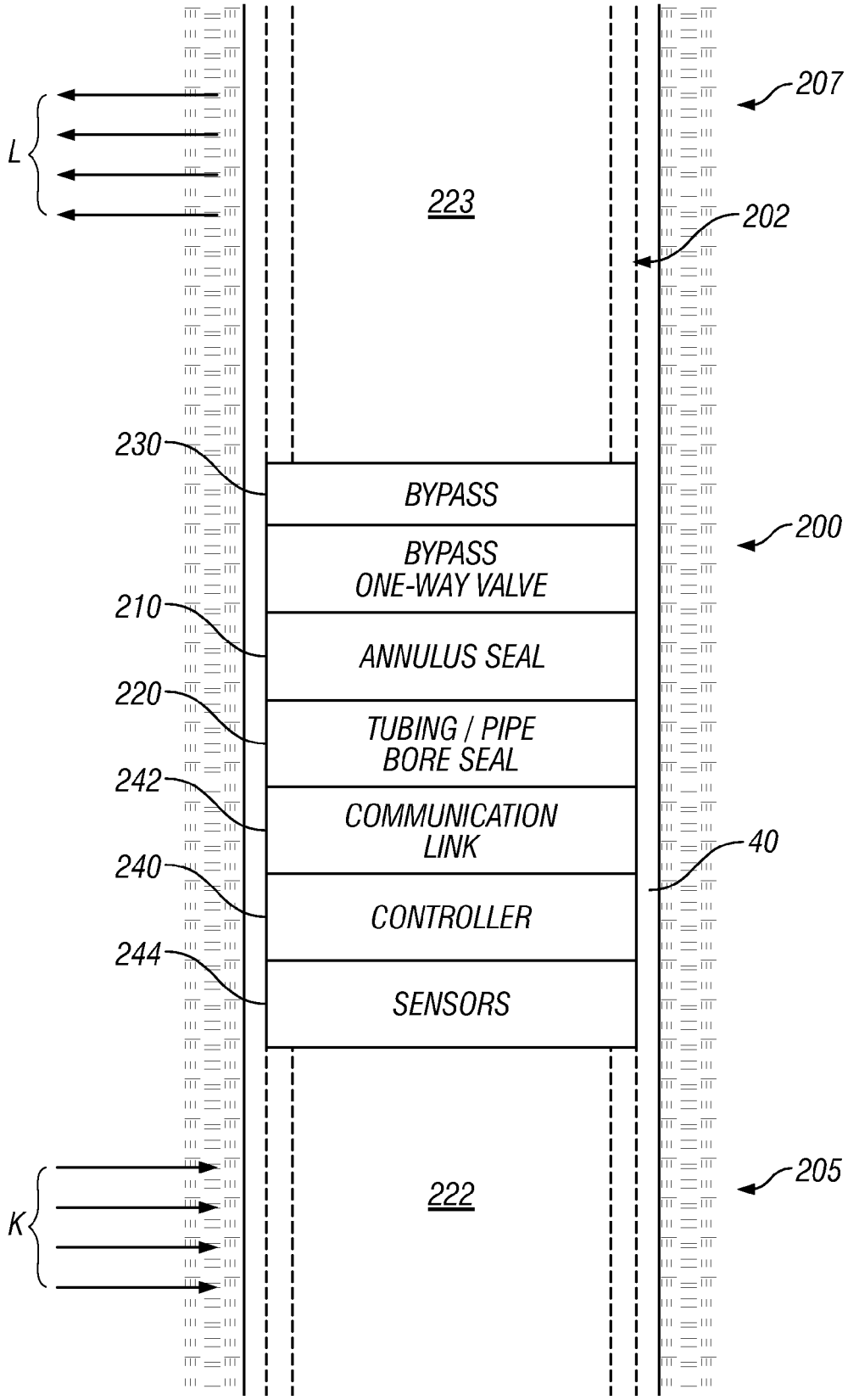
FIG. 2 schematically illustrates one embodiment of a well control device made in accordance with the present invention.

Embodiments of the well control device 200 can be used to hydraulically isolate sections of the wellbore. The out-of-norm condition associated with one or more of these isolated wellbore sections can then be treated independently. Referring now to FIG. 2, there is schematically shown a well control device 200 in a wellbore 14. When activated, the well control device 200 hydraulically isolates a lower wellbore section 205 from an upper wellbore section 207. This can be advantageous, for instance, when the two sections 205 and 207 are encountering different out-of-norm conditions; e.g., the upper wellbore section 207 could encounter a loss of fluid into the formation, shown by arrows L, and/or the lower wellbore section 205 could encounter a kick, shown by arrows K. The well control device 200 allows each section 205, 207 to be controlled or treated separately, which can provide greater flexibility in selection of an appropriate course of remedial action. Additionally, the well control device 200 can provide selective circulation of fluid in each of the sections 205, 207 by using bypass devices. The isolation need not necessarily be complete. Rather, the isolation may be to a degree substantial enough to implement a desired remedial action. Thus, terms "isolate" or "isolation" as used herein is not intended to mean or require absolutely no fluid communication across a barrier or equipment.

As shown in FIG. 2, the downhole well control device 200 may be positioned along a section of a bottomhole assembly (BHA) 202 or positioned uphole of the BHA 202 in a separate section of the drill string 24. The well control device 200 can be positioned anywhere along the BHA 202 or drill string 24, including the open hole section of the wellbore. In one embodiment, the device 200 includes an annulus seal 210 that controls flow in the well annulus 40, a pipe bore valve 220 that controls flow in the pipe bore 222 and a bypass valve 230 that can direct flow between the annulus 40 and the pipe bore 222. The terms seals, packers and valves are used herein interchangeably to refer to flow control devices that can selectively control flow across a fluid path. The control can include providing substantially unrestricted flow, substantially blocked flow, and providing an intermediate flow regime. The fluid barrier provided by these devices can be "zero leakage" or allow some controlled fluid leakage. In some embodiments, the seals and valves are responsive to command signals. Suitable flow control devices include packer-type devices, expandable seals, solenoid operated valves, hydraulically actuated devices, and electrically activated devices.

In one arrangement wherein the annulus seal 210 utilize one or more inflatable packers, the annulus seal 210 may be activated in the following manner. First, drilling fluid is circulated using the surface mud pumps 38 (FIG. 1). While the mud pumps 38 are operating, the bypass 230 is initially opened and the bore valve 220 is closed. Thereafter, the flow across the bypass 230 is modulated, e.g., restricted, to create a bore-to-annulus differential pressure. This differential pressure inflates the inflatable packer. Suitable valves (not shown) direct fluid to and from the inflatable packer.

Referring now to FIGS. 1 and 2, the well control device 200 may in one arrangement be activated by a downlink in the form of a flow variation. In another arrangement, an activation downlink or signal may be encoded into a pressure sequence. For example, initially, the pipe bore valve 220 may be normally closed prior to drilling operation. To start drilling, pressure in the drill string 24 may be built up quickly via the surface pumps 38. Once the pressure in the bore of the drill string 24 exceeds a predetermined trigger pressure, the pipe bore valve 220 opens and the pressure in the bore of the drill string 24 drops to a desired operation pressure. To activate the well control tool 100, the pressure in the drill string 24 is increased to within a predetermined pressure window, which may be lower than the trigger-pressure, and held there for a predetermined time period. Mechanical devices, such as springs, and/or hydraulic devices, such a metered nozzle, responsive to the pressure variation thereafter activate the well control tool 200. Alternatively, sensors in the drill string 24 may be used to detect that the trigger pressure has been reached and maintained for the required time period.

Additionally, a downhole controller 240 controls the operation of the seal and valve 210, 220, the bypass valve 230 and other associated equipment described below. A communication device 242 transmits signals between the controller 240 and surface equipment and personnel. In one embodiment, the communication device 242 is configured to receive downlinks encoded with instructions for operation of the well control device 200. In other embodiments, the communication device 242 is also configured to transmit uplinks encoded with data relating to sensor measurements or the operating status of the well control device 200. Thus, the communication device 242 can be both one-directional and bidirectional. The physical position of the communication device will depend on the type of communication system used. For instance, a system that utilizes flow variations or pressure pulses, the device 242 would likely be positioned uphole of the pipe valve 220. The BHA 202 can also include one or more sensors 244 for measuring parameters of interest such as formation parameters, the BHA operating parameters, drilling parameters, etc.

In a normal operating condition, the annulus seal 210 and the pipe bore valve 220 are in a de-activated condition and permit unrestricted fluid flow through the annulus 40 and pipe bore 222, respectively. The bypass valve 230 is positioned uphole of the seal and valve 210, 220 and is normally closed to prevent flow between the annulus 40 and the pipe bore 222. Thus, for example, during drilling, the drilling fluid flows down via the pipe bore 222 and returns with entrained cuttings via the annulus 40. In an out of norm condition, e.g., a well kick, the bypass valve 230 and the seal and valve 210, 220 can be activated independently or together to stabilize and control the out of norm condition. For example, the seal and valve 210, 220 can be activated to stop fluid flow in the annulus 40 and the pipe bore 222. In this condition, the section of the wellbore downhole 205 of the device 200 will be substantially hydraulically isolated from the section of the wellbore uphole 207 of the device 200. Further, by opening the bypass valve 230, fluid can be circulated in the uphole wellbore section 207, while maintaining a specified wellbore condition in the downhole wellbore section 205. This flow control regime is merely illustrative of the well control provided by the well control device 200. Still other illustrative flow control regimes will be discussed in detail below.

In one embodiment, the bypass valve 230 may be operated to transmit uplinks. The uplinks, or data signals, may include sensor measurements, equipment operating conditions, status, etc. In an exemplary arrangement, the pipe bore 222 is closed and circulation is established in the uphole section 207. Thereafter, the bypass valve 230 may be modulated using the controller 230 or other suitable device to cause pressure fluctuations in the drill string 24 or the annulus 40. That is, closing the valve 230 may cause a pressure increase, or positive pressure pulse, in the drill string 24 and a pressure drop, or negative pressure pulse, in the annulus 40. Because either or both of these pulses can be detected at the surface, these pulses may be used to transmit data from downhole to the surface. For example, the magnitude or frequency of the pulses may be controlled to convey information. Additionally, the time between pulses may be controlled as a method to convey information.

The controller 240 contains one or more microprocessors or microcontrollers for processing signals and data and for performing control functions, solid state memory units for storing programmed instructions, models (which may be interactive models) and data, and other necessary control circuits. In other embodiments, the controller 240 can be a hydro-mechanical device that incorporates known mechanisms (valves, biased members, linkages cooperating to actuate tools under, for example, preset conditions).

The communication device 242 can utilize any number of media and methodologies to provide the transfer of data, signals and commands between the surface and the well control device 200. Exemplary communication devices can utilize data encoded flow and/or pressure variations, acoustic signals, mud pulse telemetry, EM telemetry, and signals carried via conductors such as optical fibers or electrical conductors. In one arrangement, downhole reception of a downlink is enabled by downhole measurement of the flow rate or flow variations, e.g., via the rotational speed of a downhole turbine or positive displacement motor, or measurement of the downhole pressure change caused by the change in flow rate. If a pressure sensor is used, down links can be established when the pipe bore 222 is blocked below the well control device 200 by, for example, varying the pipe pressure using the surface pumps 38.

Other methodologies for transmitting a signal or signals downhole include varying the rotational speed of the drill string 24, altering the WOB, and axially manipulating the drill string 24. For example, deactivation of the well control tool 200 may be initiated by pulling or rotating the drill string 24, which creates a detectable relative movement, force and/or torque because a part of the well control tool 200, such as an expanded packer element, is fixed to the wellbore wall when activated. In still another methodology, an object such as a ball or dart can be pumped into the wellbore to activate the well control device 200 by, for example, occluding the bore 222 and thereby increasing the pressure in the bore 222 or by physically engaging a switch or other suitable actuating member (not shown). Devices suitable for transmitting an uplink and/or a downlink include wired pipe, acoustic transmitters such as piezoelectric devices, mud sirens, mud pulsers, and dynamic valves. As will be seen, each may present a particular advantage in a particular situation and it should be understood that the present invention is not limited to the communication methodologies and devices listed above.

Power for the well control device 200 can be provided by one or more downhole batteries, a downhole generator or an accumulator. Also, the high pressure mud can also be used to energize the several components of the well control device 200. In some embodiments, devices for generating power such as mud turbines can be supplemented using arrangements such as bypass valves to allow power generation and flow measurement over a wider range of flow rates than normally possible.

Figure 3:
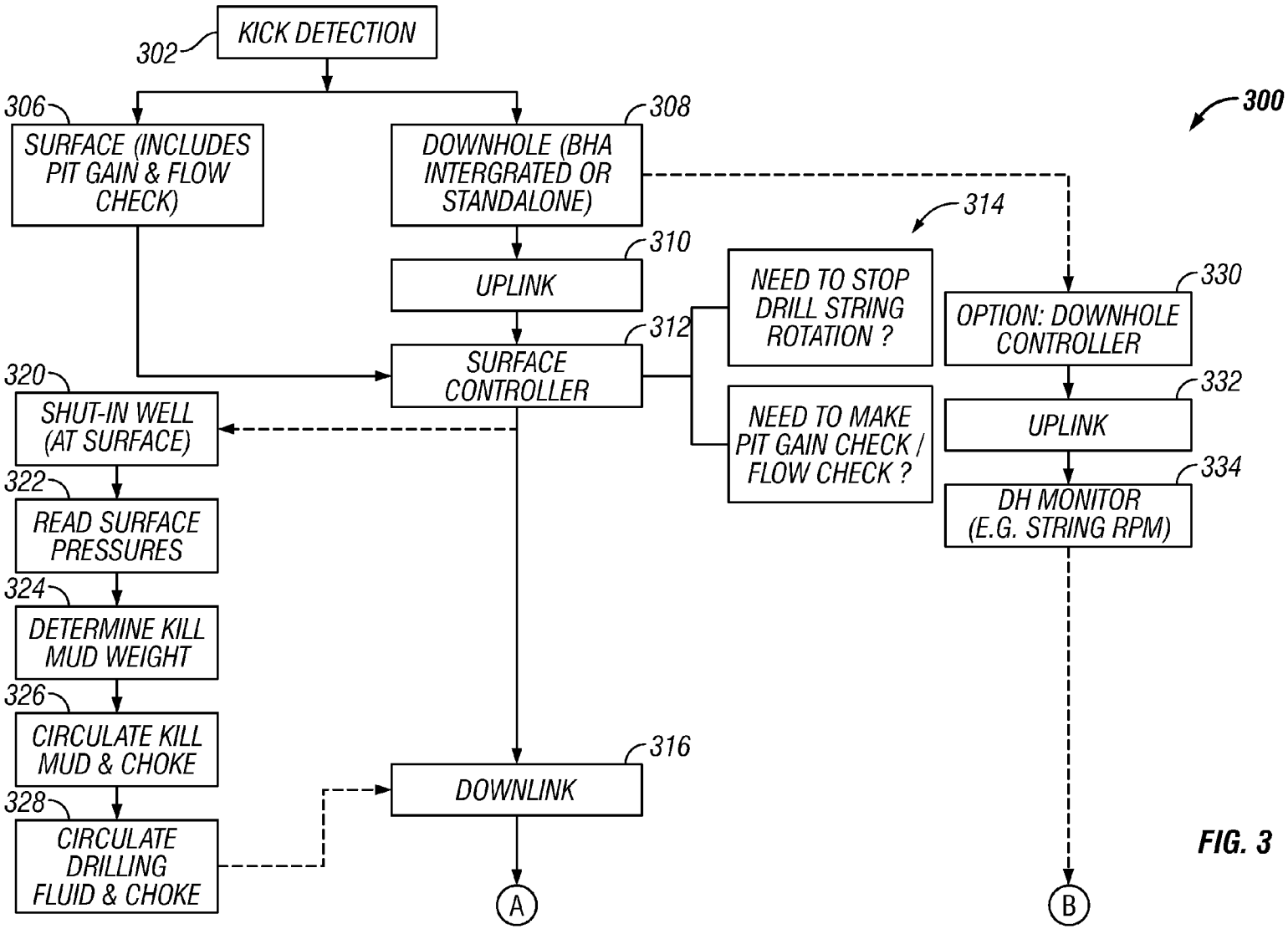
FIG. 3 illustrates a flow chart showing one exemplary methodology for controlling a well kick in accordance with the present invention.
Figure 3:
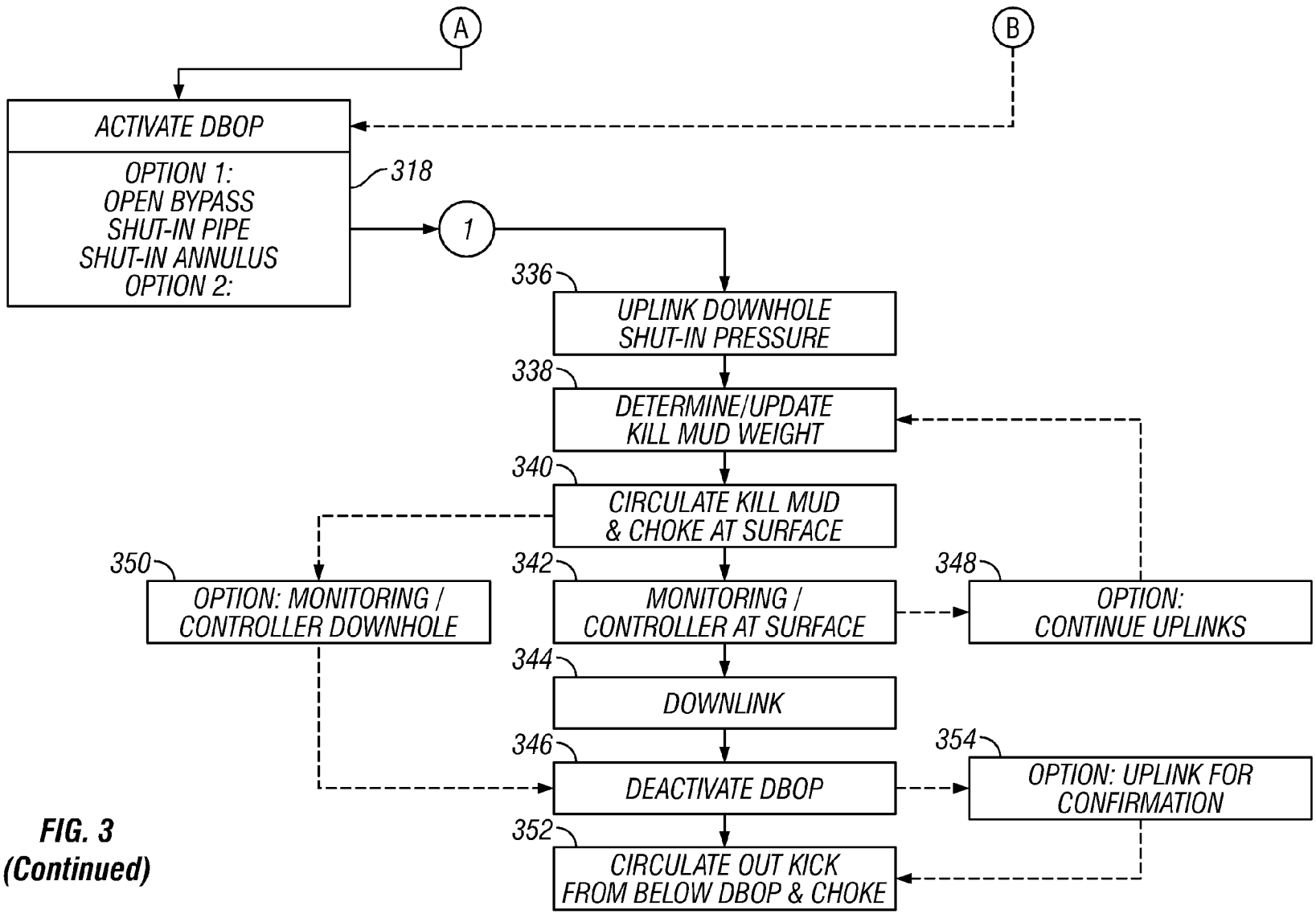

In FIG. 3, there is shown an illustrative method 300 for using the well control device 200 in a well kick situation. Referring now to FIGS. 1-3, initially, a kick detection 302 can be made either at the surface 306 or downhole 308. A surface detection 306 can be made by monitoring the volume and flow of mud into the pit, an increase being indicative of a well kick. A downhole detection 308 can be made by sensors 244 at the well control device 200, which then is transmitted by an uplink 310 to surface controller 31. The surface controller 31, using preprogrammed instructions or by prompting a human operator, can initiate a decision process 314, which can include verifying the detected kick and whether rotation has to be stopped to allow for well control device 200 activation. Subsequently, well control device 200 activation is initiated by a downlink 316.

In one variant, the downlink 316 to activate the well control device 200 may be proceeded by a surface shut-in 320 using conventional equipment. Appropriate measurements can be made, such as measuring surface pressures 322. Based on measured and/or calculated data, a suitable kill mud weight is determined 324 and circulated into the well using a choke 35 that applies 326 a suitable back pressure to control the well kick. Alternatively, the original drilling fluid can be circulated with an appropriate choke control 328. Such a process can allow an earlier stop of the influx and determination of the kill mud weight.

In another variant, an in situ decision 330 to activate the well control device 200 is made by a downhole controller 240 which sends 332 an uplink encoded with its decision to surface. Optionally, the downhole controller 240 can monitor one or more selected parameters (e.g., string RPM) 334 for a signal to proceed with the well control device 200 activation sequence.

Upon activation 318, the well control device 200 seals off the pipe bore 222, seals off the annulus 40, and opens the bypass valve 230. At this time, the kill mud weight can be determined or updated from the downhole shut-in pressure 336 which is measured and uplinked 336 by the well control device 200. Meanwhile, circulation of kill mud 340 above the well control device 200 is maintained while the surface choke 35 is used to circulate out formation fluids that were not shut-in below the well control device 200. Optionally, uplinks 348 may continue during this "killing" operation, allowing for corrections/updates with respect to the kill mud weight to be made.

Completion of this stage, which can include the annulus 40 above well control device 200 being full of kill mud of sufficient density, is determined 342 by a surface controller 31 that subsequently sends a downlink 344 to deactivate the well control device 200. In a variant, a downhole controller 240 may automatically determine completion of the stage 350 and deactivate the well control device 200. To notify surface of successful deactivation, the well control device 200 can, optionally, send an uplink 354.

After well control device 200 deactivation, any formation fluids below the well control device 200 annulus seal 210 can be circulated out 352 conventionally via the surface BOP 22 and choke 35. It should be appreciated that the annular pressure at the casing shoe 48, or other weak open hole location, is smaller than in a conventional kill operation. This is due to the kick volume below the well control device 200 being generally smaller than the total kick volume in a conventional kill operation and the annulus 40 between the well control device 200 and the casing shoe 48 being filled with the kill mud rather than drilling fluid, which reduces the pressure required at the casing shoe.

Figure 4:
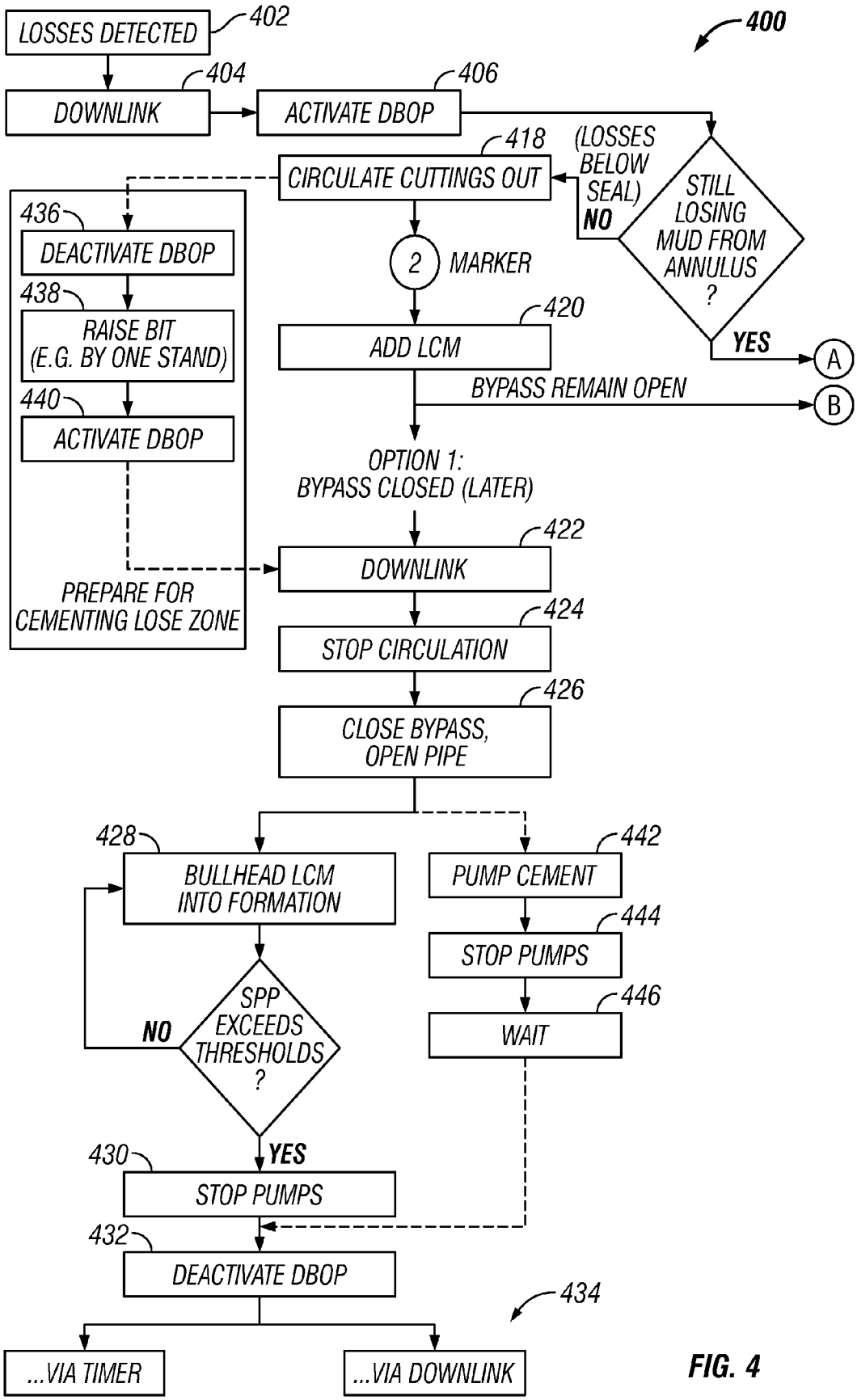
FIG. 4 illustrates a flow chart showing one exemplary methodology for controlling a fluid loss in a wellbore in accordance with the present invention.
Figure 4:
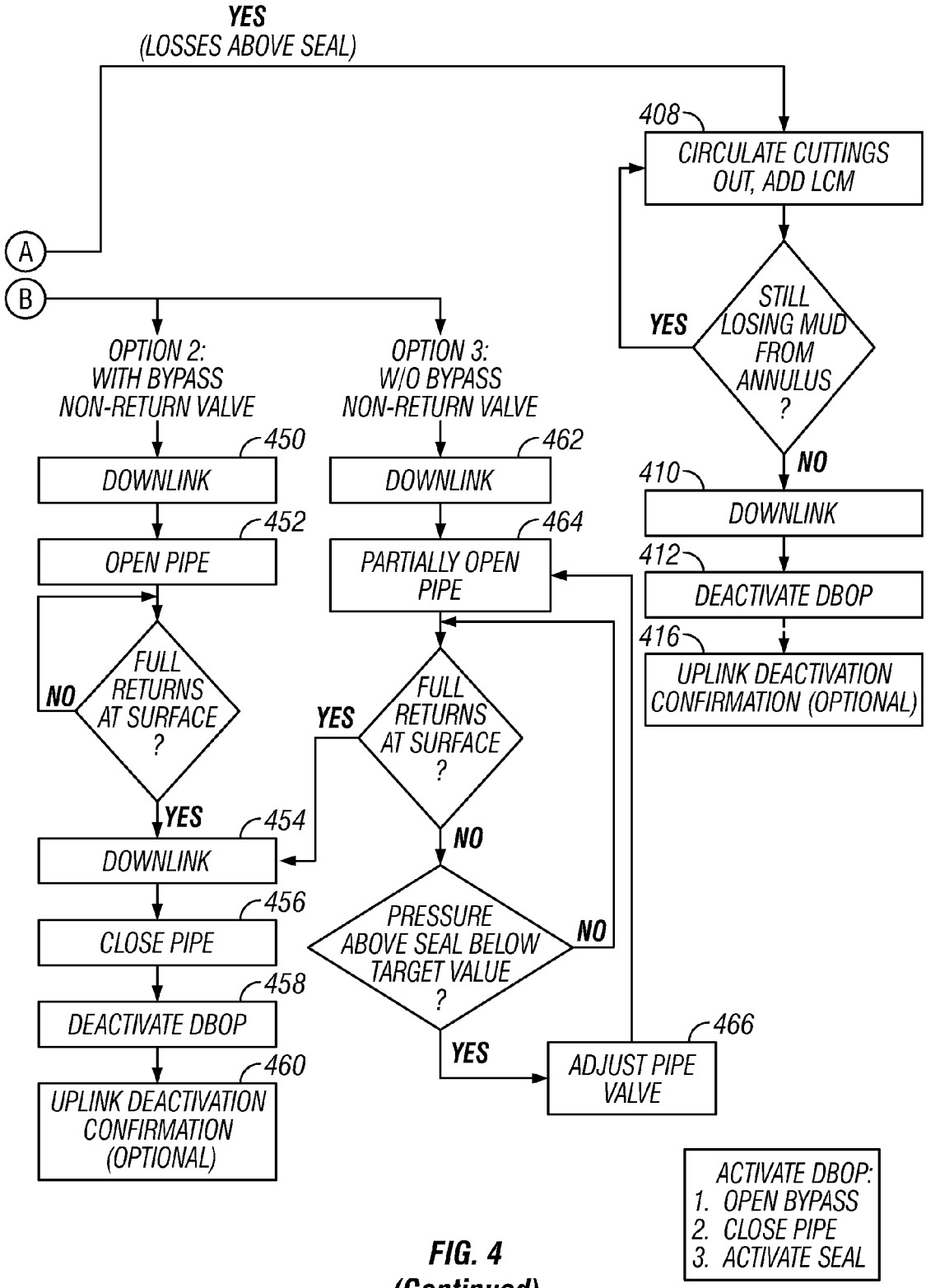

In FIG. 4, there is shown an illustrative method 400 for using the well control device 200 in a situation where drilling fluid is being lost to the formation due to weak formations.

Referring now to FIGS. 1, 2 and 4, after losses have been detected 402, either at the surface or downhole, a downlink 404 is sent to activate 406 the well control device 200 via a downlink. If the level of fluid in the mud pit 36 continues to drop or if annular mud level cannot be maintained, then it is likely that fluid is being lost to a formation above the well control device 200. If the level of fluid in the mud pit 36 stabilizes and annular mud level can be maintained, then it is likely that fluid is being lost to a formation below the well control device 200.

In the scenario where mud is lost above the well control device 200, the losses are treated by circulating 408 lost circulation material (LCM) above the well control device 200 using the open bypass valve 230. It should be appreciated that a conventional kick below the well control device 200 due to insufficient annular mud level is prevented because the well control device 200 has sealed off the annulus 40 to thereby maintain a suitably high annular pressure in the section below the well control device 200. After losses are cured, a downlink 410 is used to de-activate 412 the well control device 200. Optionally, a confirmation uplink can be transmitted 416 for the de-activation.

In the scenario where losses occur below the well control device 200, the entire annulus 40 above the well control device 200 can be maintained full of mud and, therefore, kicks due to insufficient mud level are prevented across the entire open hole section above the well control device 200 and below the casing shoe 48.

To control the well in this scenario, drilling fluid is circulated 418 to remove cuttings. Then, after cuttings are circulated out, the LCM is added 420 to the mud being pumped down. At this point, there are at least three options for pumping LCM into the loss zone below the well control device 200.

The first option involves closing the bypass valve 230. To avoid either further fracturing the loss zone or triggering the pressure relief valves at surface while the bypass closes, circulation is stopped 424 after the activation downlink 422 has been sent. After the bypass is closed 426 and the pipe valve 220 is opened, LCM can be forced 428 into the loss zone by slowly bringing up the pumps 38 because the annulus seal 210 is still closed. When losses have been treated sufficiently, e.g., as detected by standpipe pressure (SPP) exceeding a threshold, the pumps 38 are stopped 430 and the well control device 200 is deactivated 432. Several de-activation options 434 are available, including but not limited to a downlink signal or a timer that deactivates the well control device 200 after a pre-set duration.

In a variant, the loss could be treated with cement. If so, then after completing step 418, the well control device 200 is de-activated 436, the bit is pulled off bottom 438 by a certain distance, and the well control device 200 is re-activated 440. Thereafter, steps 422-426 are followed. At this point, cement is pumped 442. After the pump 38 is secured 444, the cement is allowed to set before well control device 200 deactivation 432.

The second option maintains the bypass valve 230 in an open position and uses a non-return valve to prevent flow from the annulus 40 into the pipe bore 222 through the bypass valve 230. The non-return valve prevents the annulus mud level from dropping once a connection to the loss zone is established when the pipe valve 220 opens. In this second option, a downlink is sent 450 that opens 452 the pipe valve 220. Circulation of LCM, which was initiated at step 420, continues until full returns are seen at surface, which indicates that losses have stopped. A downlink is then sent 454 to close 456 the pipe valve 220, which then is followed by de-activation 458 of the well control device 200. Optionally, a confirmation uplink is sent 460 to confirm deactivation.

The third option maintains the bypass valve 230 in an open position without using a non-return valve. Instead, a downlink is sent 462 that causes the pipe valve 220 to only partially open 464 ("choked" pipe flow) to prevent a situation in which the flow into the loss zone exceeds the pump rate so that mud is drawn from the annulus 40 and the level drops. To avoid this and, at the same time, maximize the flow of LCM into the loss formation, the pipe valve 220 can be adjusted in closed-loop control 466. The control variable could be the annulus pressure above the annulus seal 210 because dropping annulus level leads to dropping annulus pressure. The control variable could also use a measurement of the bypass flow, which must be greater than or equal to zero to avoid dropping annulus level. As in the second option, success of the losses treatment is indicated by full returns at surface and subsequent procedural steps are equivalent to the second option.

Figure 5:
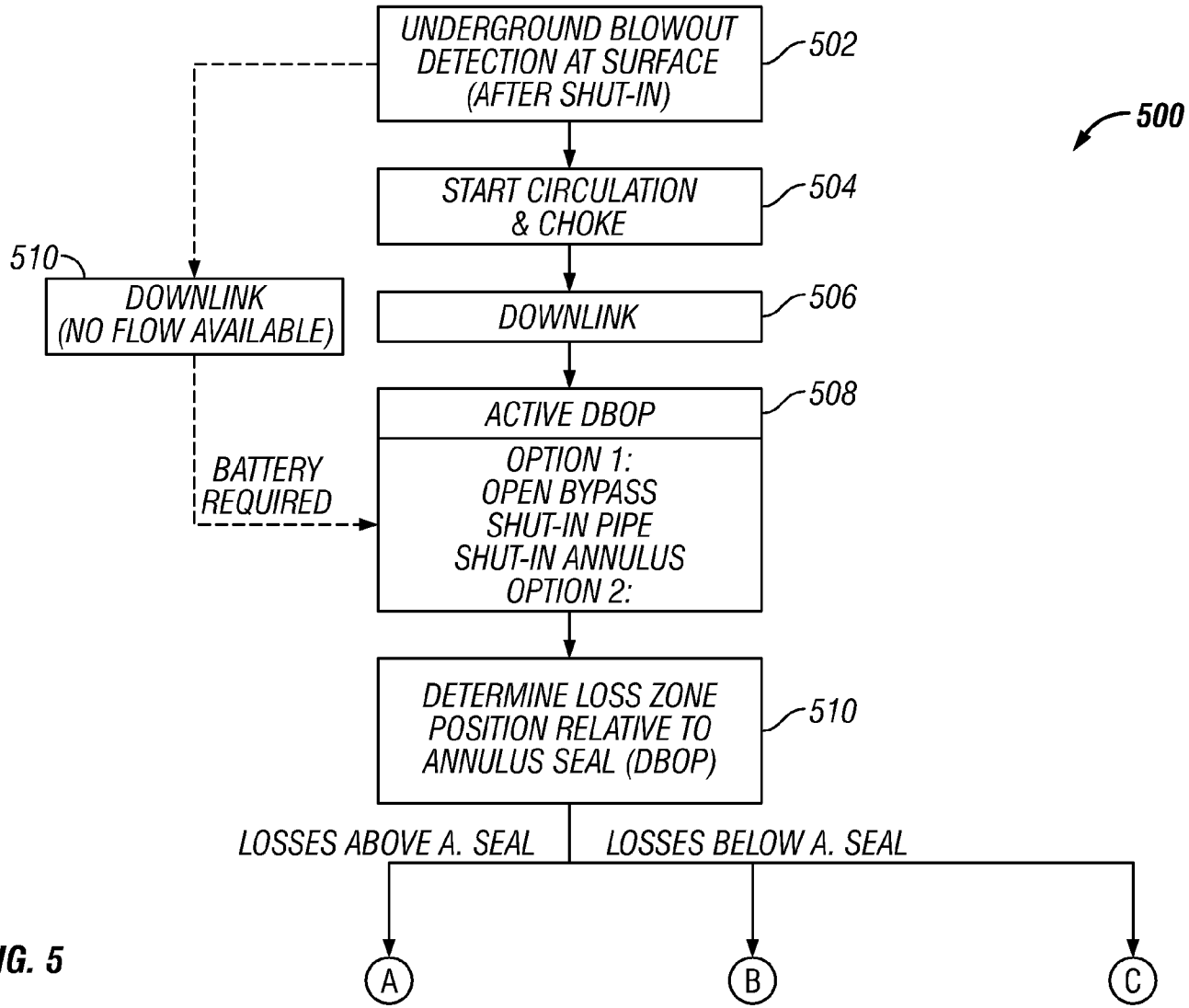
FIG. 5 illustrates a flow chart showing one exemplary methodology for controlling an underground blowout in accordance with the present invention.
Figure 5:
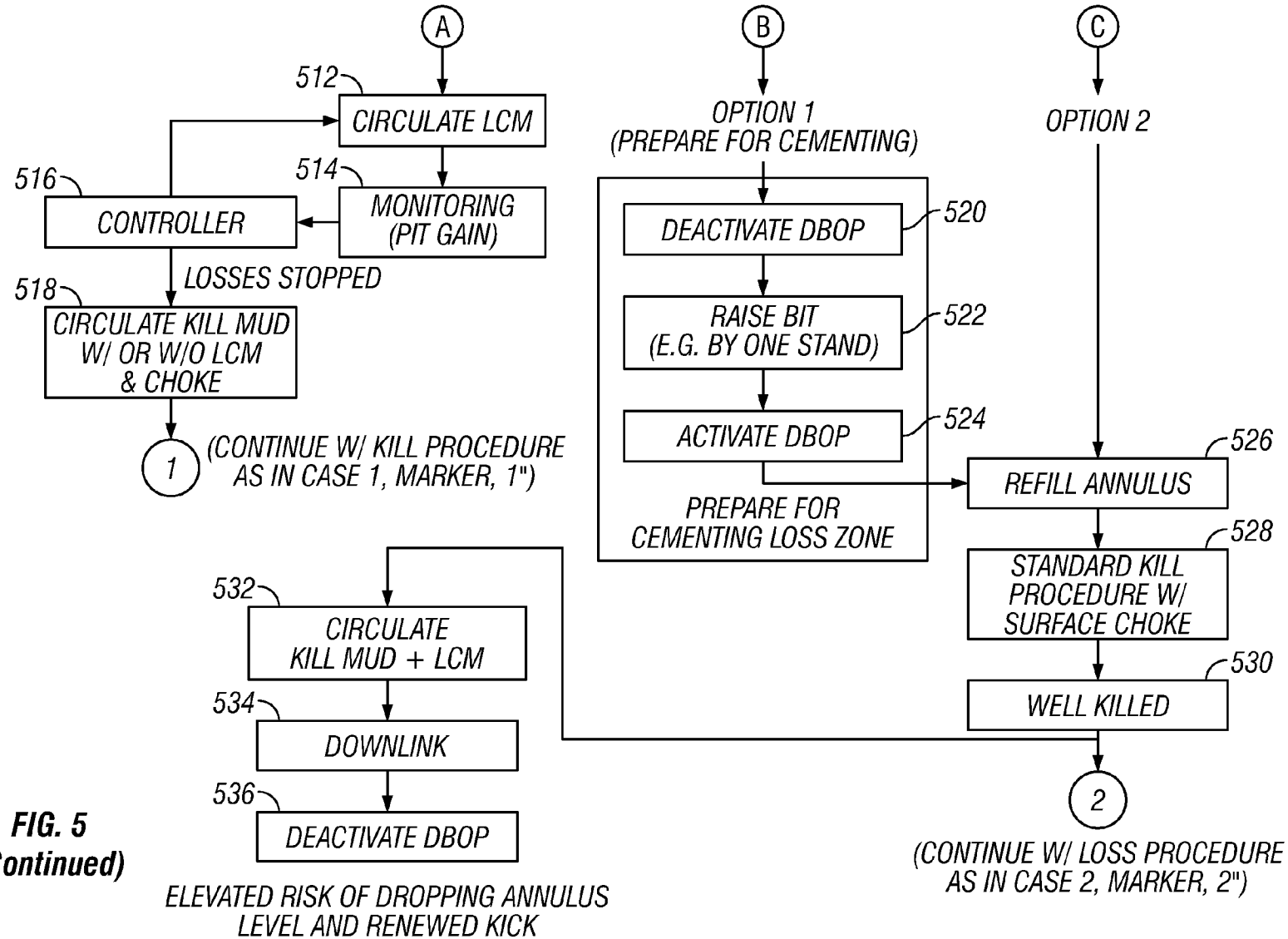

In FIG. 5, there is shown an illustrative method 500 for using the well control device 200 to control an underground blowout, that is, downhole losses and kicks occur simultaneously.

Referring now to FIGS. 1, 2 and 5, in one scenario, an underground blowout results from a shut-in 502 at surface in order to control a kick. In some situations, the well control device 200 is located between the kick and the loss zone and, when activated, provides zonal isolation between the two zones. For a downlink using circulating fluid, circulation and appropriate choke control is resumed 504 to maintain downhole pressures at the desired level and an activation downlink is sent 506. For a downlink that does not require circulation, a downlink is sent 510 for activation. A downhole source, such as a battery can provide the necessary power to enable activation of the well control device 200.

Upon well control device 200 activation 508, the position of the loss zone relative to the annulus seal 210 can be determined 510. If the level of fluid in the mud pit 36 continues to drop or if annular mud level cannot be maintained, then it is likely that fluid is being lost to a formation above the well control device 200. If the level of fluid in the mud pit 36 stabilizes and annular mud level can be maintained, then it is likely that fluid is being lost to a formation below the well control device 200.

Losses above the seal 210 can be treated by circulating 512 LCM. Parameter such as level of the mud pit 36 can be monitored 514 until a controller 31, 240 determines 516 that losses have stopped. After losses are stopped, kill mud, with or without LCM, can be circulated 518 in above the well control device 200. The bottomhole pressure measurement required for determining the kill mud weight can be uplinked continuously from the moment the well control device 200 is activated. Thereafter, steps 336-352 of FIG. 3 are executed to control the well.

For losses below the well control device 200 and the kick above the well control device 200, the annulus 40 is first refilled 526. Next, a standard kill procedure utilizing the surface choke 35 and the BOP 22 is applied 528 to kill 530 the kick. In a variant, the kill procedure may be preceded by a preparation for cementing the loss zone by steps 520, 522, 524, which have been previously discussed in connection with steps 436, 438 and 440 of FIG. 4. After the well is killed above the well control device 200, two options are available. First, the procedure starting at step 420 of FIG. 4 can be followed. Second, LCM can be added 532 to the kill mud and a downlink sent 534 to deactivate 536 the well control device 200.

In another aspect, embodiments of the present invention can utilize downhole pressure measurements to determine parameters such as wellbore pressure. For example, conventionally, after a surface shut-in, the stand pipe pressure is measured to determine wellbore pressure. Embodiments of the present invention can, after activation of the well control device 200, measure the pressure of the fluid in the annulus 40 or the pipe bore 222 below the well control device 200 to determine wellbore pressure. This pressure measurement can be uplinked to the surface for use in calculating an appropriate kill mud weight or for some other purpose. In still another aspect, embodiments of the present invention may utilized surface measured or estimated shut-in pressure. Referring now to FIG. 2, In one arrangement, shut-in pressure may be measured as follows. The annulus seal 210 may be activated while keeping the bore valve 220 open and the bypass 230 closed. With the well control equipment in this configuration, the shut-in drill-pipe pressure (SIDPP) may be measured or estimated at the surface using conventional sensors. It will be appreciated that such a measurement of SIDPP reduces the likelihood of errors caused by losses occurring in the wellbore above the annulus seal 210.

It should be appreciated that the teachings of the present invention can be applied to a variety of out-of-norm well conditions, not just those described above. The devices and embodiments described above, therefore, are merely illustrative of the arrangements useful in controlling or managing a particular out-of-norm well condition For example, in some instances, two or more well control devices may be positioned along the wellbore to provide zonal isolation and zoned circulation for multiple isolated zones.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

The invention claimed is:

1. A method for controlling flow in a wellbore formed in a formation, comprising:

conveying a drill string into the wellbore;

detecting a fluid flow between the formation and the wellbore using a sensor at the surface;

transmitting a downlink along the drill string into the wellbore using a surface controller after the sensor detects the fluid flow between the formation and the wellbore, the surface controller being configured to receive an uplink transmitted along the drill string from the wellbore;

hydraulically isolating at least a section of the wellbore in response to the signal transmitted from the surface controller by transmitting from a surface location a signal into the wellbore to initiate: (i) sealing a bore of the drill string; and (ii) sealing an annulus between the drill string and a wellbore wall;

flowing fluid between the sealed bore of the drill string and the sealed annulus using a valve positioned along the drill string; and circulating a formation fluid below the hydraulically sealed section out of the wellbore.

2. The method according to claim 1, wherein the signal is transmitted using a conductor coupled to the surface controller and positioned at least partially along the drill string.

3. The method according to claim 1, wherein the signal is transmitted using a flow variation of a fluid in the drill string.

4. The method according to claim 1, wherein the signal is transmitted using a pressure sequence in a fluid in the drill string.

5. The method according to claim 1, further comprising:

measuring a pressure in the wellbore downhole at one of: (i) the sealed bore; and (ii) the sealed annulus; and transmitting the measured pressure to the surface.

6. The method according to claim 1, further comprising:

controlling flow between the bore of the drill string and the annulus using a bypass valve;

opening the bore of the drill string;

closing the bypass valve to restrict flow between the bore of the drill string and the annulus; and measuring at a surface location a pressure in the bore of the drill string while the annulus is sealed, the bore of the drill string is open and the bypass is closed.

7. The method according to claim 1, further comprising:

programming the surface controller to detect rotation of the drill string; and sealing the annulus between the drill string and the wellbore wall after detecting a stopping of drill string rotation.

8. The method according to claim 1, further comprising circulating a kill mud uphole of the hydraulically sealed section.

9. A method for controlling flow in a wellbore formed in a formation, comprising:

conveying a drill string into the wellbore;

detecting at the surface fluid flow from the wellbore into the formation;

hydraulically isolating at least a section of the wellbore by: (i) sealing a bore of the drill string in response to the detected fluid flow, and (ii) sealing an annulus in response to the detected fluid flow; and circulating a lost circulation material into the wellbore.

10. The method according to claim 9, further comprising sealing the annulus by using a packer inflated by modulating a flow across a valve configured to control flow between the bore of the drill string and the annulus.

11. The method according to claim 9, further comprising modulating a flow between the annulus and the bore to create a bore-to-annulus differential pressure.

12. The method according to claim 9, further comprising transmitting an uplink by causing a pressure variation using a valve configured to control flow between the bore of the drill string and the annulus.

13. The method according to claim 12, further comprising controlling with the valve one of: (i) a magnitude of a pressure modulation, (ii) a frequency of pressure modulation, and (iii) time between pressure modulations.

14. The method according to claim 9, further comprising:

identifying a wellbore location where the fluid is flowing into the formation; and circulating the lost circulation material into the identified wellbore location using the hydraulically sealed section.

15. A system for controlling flow in a wellbore formed in a subterranean formation, comprising:

a sensor at the surface configured to detect a fluid flow between the wellbore and the formation;

a drill string conveyed into the wellbore;

a first flow control device positioned along the drill string configured to selectively seal a bore of the drill string;

a second flow control device positioned along the drill string and configured to selectively seal the annulus, the first flow device and the second flow device being configured to hydraulically isolate at least a section of the well when activated;

a valve positioned along the drill string, the valve configured to permit a flow of fluid between a bore of the drill string and an annulus formed between the drill string and a wellbore wall after the first flow device and the second flow device have been activated; and a surface controller configured to receive an uplink and transmit a downlink along the drill string to the first and the second flow control device after the sensor detecting the fluid flow.

16. The system according to claim 15, wherein the valve is configured to inflate the packer by modulating a flow across the valve.

17. The system according to claim 15, wherein the valve is configured to modulate a flow between the annulus and the bore to create a bore-to-annulus differential pressure.

18. The system according to claim 15, wherein the valve is configured to transmit the uplink by causing a pressure pulse in the wellbore.

19. The system according to claim 18, wherein the valve is configured to control one of: (i) a magnitude of a pressure modulation, (ii) a frequency of a pressure modulation, and (iii) time between pressure modulations.

20. The system according to claim 15, wherein one of the first flow control device, the second flow control device, and the valve is responsive to the downlink transmitted by the surface controller.

21. The system according to claim 15, further comprising a downhole controller in communication with the surface controller and transmitting a signal indicative of an operating condition of one the first flow control device, the second flow control device and the valve.

22. The system according to claim 15, further comprising a communication device associated with the drill string, the communication device being configured to transmit the uplink using one of: (i) mud pulse, and (ii) at least one conductor positioned along the drill string.

* * * * *